US009851141B2

(12) United States Patent
Burger et al.

(10) Patent No.: US 9,851,141 B2
(45) Date of Patent: Dec. 26, 2017

(54) PRESSURE CONTROL OF GAS LIQUEFACTION SYSTEM AFTER SHUTDOWN

(75) Inventors: Pieter Cornelis Burger, Zoetermeer (NL); Clemens Gerardus Johannes Maria Van Der Nat, The Hague (NL); Jozefus Gerardus Petrus Vernooij, Nice (FR)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 1265 days.

(21) Appl. No.: 13/382,036

(22) PCT Filed: Jul. 2, 2009

(86) PCT No.: PCT/EP2009/058318

§ 371 (c)(1),
(2), (4) Date: Mar. 8, 2012

(87) PCT Pub. No.: WO2011/000424

PCT Pub. Date: Jan. 6, 2011

(65) Prior Publication Data

US 2012/0167616 A1 Jul. 5, 2012

(51) Int. Cl.
*F25J 1/00* (2006.01)
*F25J 1/02* (2006.01)

(52) U.S. Cl.
CPC ..... *F25J 1/0268* (2013.01); *F25J 1/0022* (2013.01); *F25J 1/0052* (2013.01); *F25J 1/0057* (2013.01);

(Continued)

(58) Field of Classification Search
CPC ..... F25J 1/0211–1/0218
See application file for complete search history.

(56) References Cited

U.S. PATENT DOCUMENTS 3,529,433 A * 9/1970 Chambers ..... F25B 49/027 62/196.1
3,668,882 A * 6/1972 Sarsten ..... F25B 9/006 137/93

(Continued)

FOREIGN PATENT DOCUMENTS

GB 2065284 A1 6/1981
JP 2001133065 5/2001

(Continued)

OTHER PUBLICATIONS

WO2011000424 ISR.*

(Continued)

*Primary Examiner* — Frantz Jules
*Assistant Examiner* — Brian King
(74) *Attorney, Agent, or Firm* — Steve M. Koehler; Westman, Champlin & Koehler, P.A.

(57) ABSTRACT

A method is provided for operating a system for the liquefaction of gas of the type comprising a main heat exchange vessel, a bundle for the gas to be liquefied extending through said MCHE and a refrigerant compression circuit of which a first end leads evaporated refrigerant from the vessel towards a compressor and a second end supplies the compressed and cooled refrigerant from the compressor towards the MCHE. For avoiding problems during heat up or during start up of the heat exchanger the pressure within the liquefaction system is controlled by regulating the amount of evaporated refrigerant in the liquefaction circuit.

10 Claims, 1 Drawing Sheet

(52) U.S. Cl.
CPC ..... *F25J 1/0247* (2013.01); *F25J 1/0248* (2013.01); *F25J 2210/42* (2013.01); *F25J 2210/62* (2013.01); *F25J 2270/904* (2013.01)

(56) References Cited

U.S. PATENT DOCUMENTS

| | | | | |
|---|---|---|---|---|
| 4,334,902 | A | 6/1982 | Paradowski | |
| 4,638,639 | A * | 1/1987 | Marshall | F25J 1/0015 62/51.1 |
| 4,901,533 | A * | 2/1990 | Fan | F25J 1/0022 62/614 |
| 5,893,274 | A * | 4/1999 | Nagelvoort | F25J 1/0022 62/613 |
| 5,931,021 | A * | 8/1999 | Shnaid | F25J 1/0012 62/51.2 |
| 6,523,366 | B1 * | 2/2003 | Bonaquist | F25B 9/002 62/613 |
| 6,530,240 | B1 * | 3/2003 | Kountz | F04C 28/08 62/149 |
| 2008/0307826 | A1 * | 12/2008 | Coward | 62/611 |
| 2009/0071190 | A1 * | 3/2009 | Potthoff et al. | 62/614 |

FOREIGN PATENT DOCUMENTS

| | | |
|---|---|---|
| WO | 2007011155 | 1/2007 |
| WO | 2009072900 | 6/2009 |

OTHER PUBLICATIONS

PCT Search Report for PCT/EP209/058318, dated Feb. 8, 2012.
Written Opinion, International Application PCT/EP209/058318, dated Feb. 8, 2012.

* cited by examiner

PRESSURE CONTROL OF GAS LIQUEFACTION SYSTEM AFTER SHUTDOWN

CROSS-REFERENCE TO RELATED APPLICATION

This application is a Section 371 National Stage Application of International Application PCT/EP2009/058318 filed Jul. 2, 2009 and published as WO2011/000424 in English.

BACKGROUND

The discussion below is merely provided for general background information and is not intended to be used as an aid in determining the scope of the claimed subject matter.

During the manufacture of liquefied gas, for example LNG, often use is made of a liquefaction process using an evaporating refrigerant. During shut down of the liquefaction process (for example when the process plant is subject to repairs or servicing) heat ingress from the environment will lead to evaporation of part of the liquid refrigerant contained inside the refrigerant circuit with concurrent potentially problematic pressure increase. On the other hand, when the liquefaction process is started up after such a period of standstill a fast cooling down of the system and in particular of its main cryogenic heat exchanger (MCHE) sometimes may lead to thermal stresses potentially causing leaks.

The pressure inside both the low pressure part and high pressure part of the liquefaction system depends on the quantity of evaporated refrigerant blocked inside these parts of the liquefaction system. Specifically, during heat up of the system evaporated refrigerant would lead to a pressure increase. By withdrawing part of the evaporated refrigerant such pressure increase is (at least partially) compensated. Withdrawal of evaporated refrigerant to a blow off system is done by opening pressure control valves and at too high pressure by opening safety relief valves.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background An aspect of the present invention is to provide an improved method for operating a process for the liquefaction of gas of the type comprising a method that uses evaporation of a refrigerant as the means to cool and liquefy gas. The evaporated refrigerant is part of a circuit that leads towards a compressor and after condensation at higher pressure supplies the liquid refrigerant via an expander or pressure let-down valve towards the MCHE for evaporation.

To avoid withdrawal of evaporated refrigerant to a blow off system, in one embodiment a balance line connects the low pressure part of the liquefaction system (including the MCHE) to a drum which contains refrigerant and which is provided with heat transfer means which are operated for withdrawing heat from the refrigerant in the drum.

As a result of withdrawing heat from the refrigerant in the drum part of the evaporated refrigerant therein will condense. This automatically will lead to a flow of evaporated refrigerant from the MCHE through the balance line towards the drum with resulting pressure compensation within the MCHE.

As an alternative it is possible that the high pressure part of the liquefaction system is provided with heat transfer means which are operated for withdrawing heat from the refrigerant in the high pressure part.

For example, when the high pressure part of the liquefaction system comprises a vapor/liquid separator, this may be provided with said heat transfer means. As a result again part of the evaporated refrigerant in the high pressure part of the liquefaction system is condensed with resulting flow of evaporated refrigerant out of the liquefaction system.

During start up of the liquefaction process another heat exchanger in the same drum might be used to enhance evaporation of refrigerant when the pressure in the MCHE becomes low.

In one embodiment, then, a balance line connects the MCHE to a refrigerant drum which contains refrigerant and which is provided with heat transfer means which are operated for supplying heat to the refrigerant in the drum.

Supplying heat leads to evaporation of part of the refrigerant in the drum with a resulting flow towards the MCHE. This will compensate for the pressure drop in the MCHE which will occur during start up.

Thus, the same system of balance line and refrigerant drum may be used during heat up and during start up situations.

Correspondingly, however, it is possible too that the high pressure part of the liquefaction system is provided with heat transfer means which are operated for supplying heat to the refrigerant, for example when the high pressure part comprises a vapor/liquid separator which is provided with said heat transfer means. Again, the same system of storage and heat transfer means provided therein may be used during heat up and during start up situations.

As an alternative method during start up, liquid refrigerant is injected directly into the MCHE. Because the liquid refrigerant is injected in a relative warm environment it evaporates. As a secondary effect the injected liquid refrigerant supports the start up (cooling down).

It is possible that the heat transfer means comprise a heat transfer coil through which a secondary refrigerant may be circulated.

For example said secondary refrigerant is LNG or liquid nitrogen (which, preferably, has a boiling trajectory below the boiling trajectory of part of the refrigerant components).

Finally, as an example of refrigerant used for the liquefaction of the gas, a mixed refrigerant is suggested, comprising a mixture of, for example, propane, ethane, methane and nitrogen.

In a second aspect the invention relates to a cryogenic heat exchanger for the liquefaction of gas of the type comprising a main heat exchange vessel, a line for the gas to be liquefied extending through said MCHE and a refrigerant compression circuit of which a first end leads evaporated refrigerant from the MCHE towards a compressor and a second end supplies the liquid refrigerant from the condenser via an expander or pressure letdown valve towards the MCHE.

In accordance with another aspect of the present invention the cryogenic heat exchanger is characterized by control means for controlling the pressure, after shut down of the liquefaction system, within the MCHE by regulating the ratio between liquid and evaporated refrigerant.

Specifically said control means may be adapted for, during heat up of the heat exchanger, withdrawing evaporated refrigerant from the MCHE and for, during start up of the process, supplying evaporated refrigerant to the MCHE.

In one embodiment of said invention a balance line connects the MCHE to a refrigerant drum which contains refrigerant and which is provided with heat transfer means.

In an alternative embodiment, however, the high pressure part of the liquefaction system is provided with heat transfer means, and may comprise a vapor/liquid separator which is provided with said heat transfer means.

As yet an alternative embodiment the MCHE comprises means, for example nozzles, for supplying liquid refrigerant directly into the MCHE.

Finally the heat transfer means may comprise a heat transfer coil through which a secondary refrigerant may be circulated. But also other means for supplying or withdrawing heat may be provided.

BRIEF DESCRIPTION OF THE DRAWINGS

Hereinafter the invention will be elucidated while referring to the drawing, in which.

DETAILED DESCRIPTION

Figure 1:
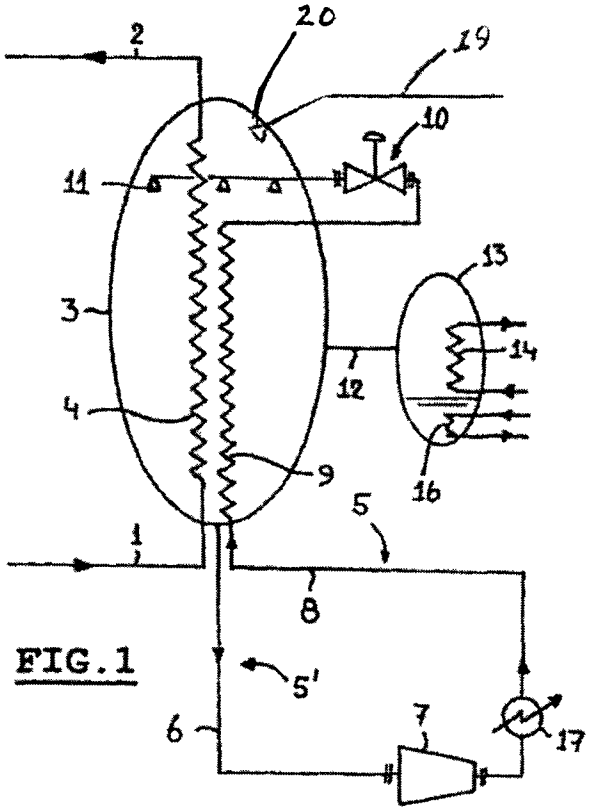
FIG. 1 schematically shows a first embodiment of the invention.

Firstly referring to FIG. 1 a first embodiment of a cryogenic heat exchanger for the liquefaction of gas is illustrated fit for carrying out the method according to an aspect of the invention. The gas is supplied by a feed line 1 and is withdrawn as liquefied gas by a discharge line 2. The heat exchanger illustrated schematically is of the type comprising a main cryogenic heat exchanger or vessel (MCHE) 3, a bundle 4 for the gas to be liquefied extending through said MCHE 3 between the feed and discharge lines 1 and 2, respectively, and a refrigerant circuit 5-5' of which a first end is the low pressure part 5' of the liquefaction system that leads evaporated refrigerant, coming from the pressure letdown valve 10 through the distributor 11 in top of vessel 3, via line 6 towards a compressor 7 and of which a second end is the high pressure part 5 of the liquefaction system that leads the compressed refrigerant from compressor 7 via a condenser 17 towards the MCHE 3.

The refrigerant entering the MCHE 3 by means of line 8 of the compression circuit 5' flows upward through a bundle 9 and (after passing pressure letdown valve 10 not further elucidated here) is discharged by distributor 11 and falls down by gravity while evaporating. The evaporated refrigerant is collected by line 6 of the compression circuit at the bottom of the MCHE.

The refrigerant passing through the MCHE 3 is in a heat exchange relation with respect to the gas passing through the MCHE (bundle 4) in a manner known per se which, therefore, needs no further explanation.

As refrigerant for use in such a cryogenic heat exchanger optionally a so-called mixed refrigerant may be used, comprising a mixture of, for example, propane, ethane, methane and nitrogen.

FIG. 1 shows an embodiment of the invention. In this embodiment a balance line 12 connects the MCHE 3 to a refrigerant drum 13 which contains refrigerant and which is provided with heat transfer means 14 and 16. In the illustrated embodiment the heat transfer means 14 comprise a heat transfer coil above the liquid level through which a secondary refrigerant may be circulated, such as for example LNG (which has a lower boiling point than the mixed refrigerant). The heat transfer means 16 comprises a heat transfer coil below the liquid level through which a heating medium may be circulated, such as for example steam, water or electricity.

By means of the refrigerant drum 13 and balance line 12 the pressure within the MCHE 3 may be controlled by regulating the quantity of evaporated refrigerant. For example, during heat up of the MCHE 3 (this may occur when the heat exchanger is not operative for reasons of servicing, repairs or otherwise of the process plant) the heat exchange means 14 withdraw heat from the refrigerant within the drum 13, and part of the evaporated refrigerant within the drum condenses which will lead to a corresponding flow and withdrawal of evaporated refrigerant from the MCHE 3 through the balance line 12.

During start up of the heat exchanger (for example after a period of standstill) evaporated refrigerant is supplied to the MCHE 3. This is achieved by supplying heat to the refrigerant in the drum 13 by circulating a heating medium through the heat transfer means 16, which results in a corresponding evaporation of part of the refrigerant in the drum 13 and a flow thereof through the balance line 12 into the MCHE 3.

Figure 2:
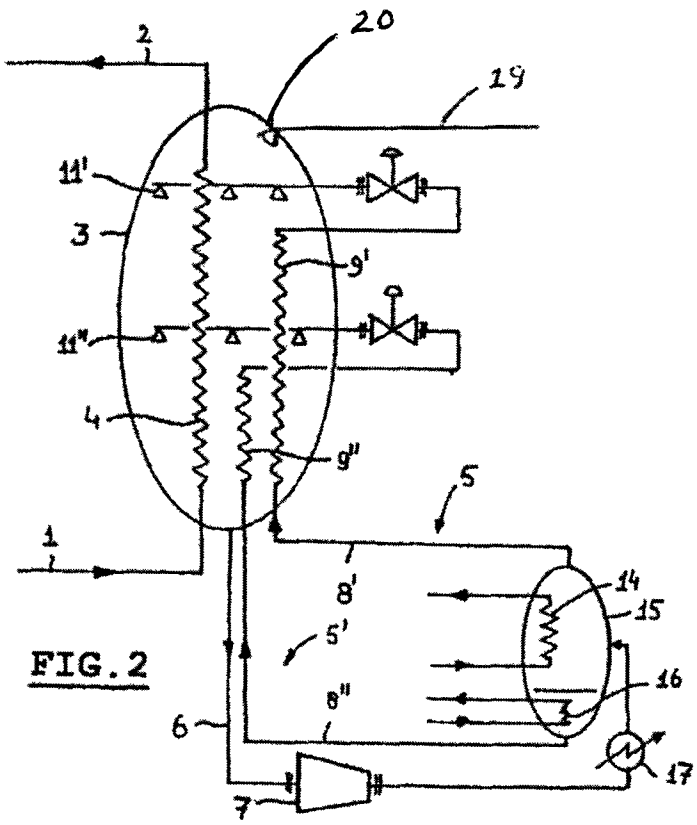
FIG. 2 schematically shows a second embodiment of the invention.

As an alternative liquid refrigerant may be injected directly into the MCHE 3 as illustrated in FIGS. 1 and 2 by supply line 19 and injector 20.

FIG. 2 shows an alternative embodiment of the invention. In this embodiment the additional drum 13 is omitted and the high pressure part 5 of the liquefaction system is provided with heat transfer means 14 and 16 which are operated for withdrawing heat from the refrigerant in the compression circuit and for supplying heat thereto (during heat up or start up, respectively).

In this embodiment the compression circuit 5 comprises a vapor/liquid separator 15 which is provided with said heat transfer means 14 and 16. The separator 15 is connected to the MCHE by a vapor line 8' and a liquid line 8". Basically the operation is as explained with respect to the embodiment according to FIG. 1, but now the vapor line 8' operates as balance line.

It is noted that the high pressure part of the liquefaction system 5 also may be provided with other components which, in a corresponding manner, are provided with heat exchange means 14 and 16 for withdrawing/supplying heat.

The invention is not limited to the embodiments described before which may be varied in many ways within the scope of the invention as defined by the appending claims.

The invention claimed is:

1. A method for operating a liquefaction system for the liquefaction of gas comprising a main heat exchanger or vessel (MCHE), a bundle for the gas to be liquefied extending through said MCHE, comprising:

providing a refrigerant compression circuit of which a low pressure part leads evaporated refrigerant from the MCHE towards a compressor and a condenser for providing a compressed and cooled refrigerant that is provided to a high pressure part having compressed and cooled refrigerant at a pressure higher than said evaporated refrigerant in the low pressure part, the high pressure part supplying the compressed and cooled refrigerant from the compressor towards the MCHE;

providing a drum having a quantity of said refrigerant partly in the form of a condensed refrigerant and partly in the form of said evaporated refrigerant and heat transfer members having surfaces configured to heat said condensed refrigerant or cool the evaporated refrigerant, connecting the drum to the low pressure part by a balance line, controlling pressure within the liquefaction system by operating the heat transfer members for regulating a quantity of said evaporated refrigerant in the drum and, through an exchange of said evaporated refrigerant between the drum and low pressure part through the balance line only, in the low pressure part by heating said condensed refrigerant via the heat transfer members in a first operating, state for supplying said evaporated refrigerant from the drum to the low pressure part through the balance line, and by cooling said evaporated refrigerant via the heat transfer members in a second operating state for withdrawing said evaporated refrigerant from the low pressure part towards the drum through the balance line.

2. The method according to claim 1, wherein operating the heat transfer members comprises operating the heat transfer members in the second operating state to withdraw heat from the refrigerant in the drum during heat up of the heat exchanger so as to withdraw refrigerant from the low pressure part of the liquefaction system.

3. The method according to claim 1, wherein operating the heat transfer members comprises operating the heat transfer members in the first operating state to supply heat to the refrigerant in the drum during start up of the heat exchanger so as to supply the refrigerant to the low pressure part.

4. The method according to claim 3, and further comprising injecting liquid refrigerant directly into the MCHE.

5. The method according to claim 1, wherein the refrigerant is a mixed refrigerant, comprising a mixture of propane, ethane, methane and nitrogen.

6. The method according to claim 1, wherein operating the heat transfer members comprises operating the heat transfer members in the second operating state to withdraw heat from the refrigerant in the vapor/liquid separator during heat up of the heat exchanger so as to withdraw refrigerant from the low pressure part of the liquefaction system.

7. The method according to claim 1, wherein the heat transfer members comprise a heat transfer coil.

8. The method according to claim 7, wherein the heat transfer coil circulates a secondary refrigerant or a heating medium.

9. The method according to claim 8, wherein the secondary refrigerant is LNG or liquid nitrogen.

10. The method according to claim 1, and further comprising injecting refrigerant directly into the MCHE.

* * * * *